US009395130B2

(12) United States Patent
Jacobson

(10) Patent No.: US 9,395,130 B2
(45) Date of Patent: Jul. 19, 2016

(54) DROP-IN FIXED MAGAZINE

(71) Applicant: California Business Environments, Inc., Minden, NV (US)

(72) Inventor: Jay Leonard Jacobson, Minden, NV (US)

(73) Assignee: CALIFORNIA BUSINESS ENVIRONMENTS, INC., Minden, NJ (US)

( * ) Notice: Subject to any disclaimer, the term of this patent is extended or adjusted under 35 U.S.C. 154(b) by 0 days.

(21) Appl. No.: 14/488,609

(22) Filed: Sep. 17, 2014

(65) Prior Publication Data

US 2015/0082678 A1 Mar. 26, 2015

Related U.S. Application Data

(60) Provisional application No. 61/880,667, filed on Sep. 20, 2013.

(51) Int. Cl.
*F41A 3/58* (2006.01)
*F41A 9/65* (2006.01)
*F41A 17/38* (2006.01)

(52) U.S. Cl.
CPC .. *F41A 9/65* (2013.01); *F41A 17/38* (2013.01)

(58) Field of Classification Search
CPC ..... F41A 9/65; F41A 17/38
USPC ..... 42/6, 11, 17, 18, 19, 21, 22, 24, 29, 33, 42/35, 37, 39, 49.01, 50, 49.1; 89/33.01, 89/33.1, 33.14, 34
See application file for complete search history.

(56) References Cited

U.S. PATENT DOCUMENTS

| | | | | | |
|---|---|---|---|---|---|
| 2,380,083 | A | * | 7/1945 | Spagnolo | 42/18 |
| 3,005,279 | A | * | 10/1961 | Brewer | 42/18 |
| 3,019,542 | A | * | 2/1962 | Manthos | 42/18 |
| 3,020,662 | A | * | 2/1962 | Merkel | 42/11 |
| 3,167,876 | A | * | 2/1965 | Milory, Jr. | 42/7 |
| 3,636,647 | A | * | 1/1972 | Goldin | 42/50 |
| 4,408,409 | A | * | 10/1983 | Arias L. | 42/50 |
| 4,982,520 | A | * | 1/1991 | Lee | 42/49.01 |
| 5,235,769 | A | * | 8/1993 | Stead et al. | 42/11 |
| 5,771,620 | A | * | 6/1998 | Crawford et al. | 42/19 |
| 2005/0183310 | A1 | * | 8/2005 | Finn | 42/49.01 |

* cited by examiner

*Primary Examiner* — Bret Hayes
(74) *Attorney, Agent, or Firm* — Bennet K. Langlotz; Langlotz Patent & Trademark Works, Inc.

(57) ABSTRACT

Drop-in fixed magazines have a tubular body defining an elongated passage and having a lower end and an upper end, the body having an exterior surface that closely fits the profile of the magazine well, and the body including protrusions of the upper end extending laterally beyond the profile. The protrusions may engage a surface of the rifle to limit downward movement of the body within the magazine well. The rifle may have to be operationally disabled to enable the magazine to be installed into or removed from the magazine well. The rifle may include an upper receiver and a lower receiver, the lower receiver may have a top, and the upper receiver may have to be removed from lower receiver, thereby exposing the top of the lower receiver, in order to enable the magazine to be installed into or removed from the magazine well.

18 Claims, 7 Drawing Sheets

DROP-IN FIXED MAGAZINE

CROSS-REFERENCE TO RELATED APPLICATION

This application claims the benefit of U.S. Provisional Patent Application No. 61/880,667 filed on Sep. 20, 2013, entitled "DROP-IN FIXED MAGAZINE (aka DFM)," which is hereby incorporated by reference in its entirety for all that is taught and disclosed therein.

FIELD OF THE INVENTION

The present invention relates to firearms, and more particularly to a drop-in fixed magazine for firearms.

BACKGROUND OF THE INVENTION

A magazine is an ammunition storage and feeding device within, or attached to, a repeating firearm. The magazine functions by moving the cartridges stored in the magazine into a position where they may be chambered by the action of the firearm. Most magazines designed for use with a reciprocating bolt firearm utilize a set of feed lips which stops the vertical motion of the cartridges out of the magazine but allows one cartridge at a time to be pushed forward (stripped) out of the feed lips by the firearm's bolt into the chamber.

Some form of spring and follower combination is almost always used to feed cartridges to the lips, which can be located either in the magazine (most removable box magazines) or built into the firearm (fixed box magazines). A box (or "stick") magazine, the most popular type of magazine in modern rifles and handguns, stores cartridges in a straight or gently curved column, either one above the other or staggered zigzag fashion. As the firearm cycles, cartridges are moved to the top of the magazine by a follower driven by spring compression to either a single feed position or alternating feed positions. In most firearms, the magazine follower engages a slide-stop to hold the slide back and keep the firearm out of battery when the magazine is empty and all rounds have been fired. Box magazines may be integral to the firearm or removable.

A detachable box magazine is a self-contained mechanism capable of being loaded or unloaded while detached from the host firearm. They are inserted into a magazine well in the firearm receiver usually below the action, but occasionally positioned to the side or on top. When the magazine is empty, it can be detached from the firearm and replaced by another full magazine while the firearm remains in an operable state. This significantly speeds the process of reloading, allowing the operator quick access to ammunition. This type of magazine may be straight or curved, the curve being necessary if the rifle uses rimmed ammunition or ammunition with a tapered case.

In some jurisdictions, a semi-automatic firearm such as the extremely popular AR-15 rifle, is prohibited to the general public when it is equipped with a conventional detachable box magazine that enables rapid reloading. However, if the semi-automatic firearm is equipped with a fixed magazine that cannot be removed from the firearm unless the firearm is in an inoperable state, the firearm is not prohibited, and is not subject to the associated legal restrictions.

People seeking to develop skills and enjoy the many advances of the AR-15 platform, but who live in jurisdictions where standard versions are prohibited, thus would require a fixed magazine version of the rifle. However, this requires the rifle design to deviate substantially from the conventional format. Moreover, there are challenges with loading a fixed magazine on an AR-15 rifle, including access to the open end of the magazine, and time to load each cartridge. In addition, people prefer to own a rifle that can be adapted to conventional use with detachable magazines in the event the owner leaves the jurisdiction where the prohibition applies. Thus, existing rifles that comply with prohibitions are less desirable when they have configurations or modifications that render them unable to accept conventional detachable magazines.

Therefore, a need exists for a new and improved drop-in fixed magazine that enables a semi-automatic firearm to have a fixed magazine without requiring modifications to the firearm. In this regard, the various embodiments of the present invention substantially fulfill at least some of these needs. In this respect, the drop-in fixed magazine according to the present invention substantially departs from the conventional concepts and designs of the prior art, and in doing so provides an apparatus primarily developed for the purpose of providing a semi-automatic firearm with a fixed magazine without requiring modifications to the firearm.

SUMMARY OF THE INVENTION

The present invention provides an improved drop-in fixed magazine, and overcomes the above-mentioned disadvantages and drawbacks of the prior art. As such, the general purpose of the present invention, which will be described subsequently in greater detail, is to provide an improved drop-in fixed magazine that has all the advantages of the prior art mentioned above.

To attain this, the preferred embodiment of the present invention essentially comprises a tubular body defining an elongated passage and having a lower end and an upper end, the body having an exterior surface that closely fits the profile of the magazine well, and the body including protrusions of the upper end extending laterally beyond the profile. The protrusions may engage a surface of the rifle to limit downward movement of the body within the magazine well. The rifle may have to be operationally disabled to enable the magazine to be installed into or removed from the magazine well. The rifle may include an upper receiver and a lower receiver, the lower receiver may have a top, and the upper receiver may have to be removed from lower receiver, thereby exposing the top of the lower receiver, in order to enable the magazine to be installed into or removed from the magazine well. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1A:
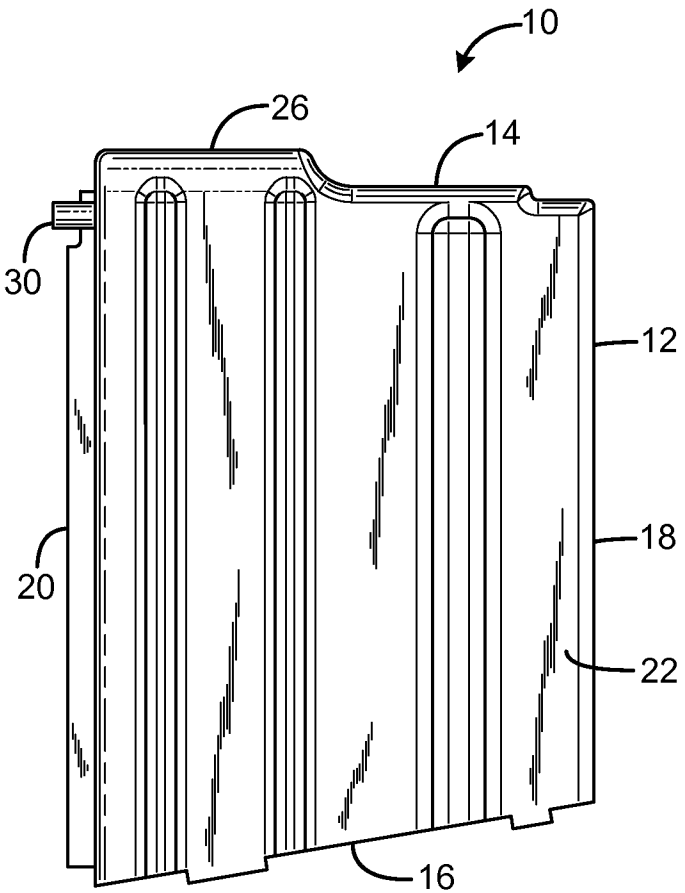
FIG. 1A is a right side view of the current embodiment of the drop-in fixed magazine constructed in accordance with the principles of the present invention.

An embodiment of the drop-in fixed magazine of the present invention is shown and generally designated by the reference numeral 10.

Figure 1B:
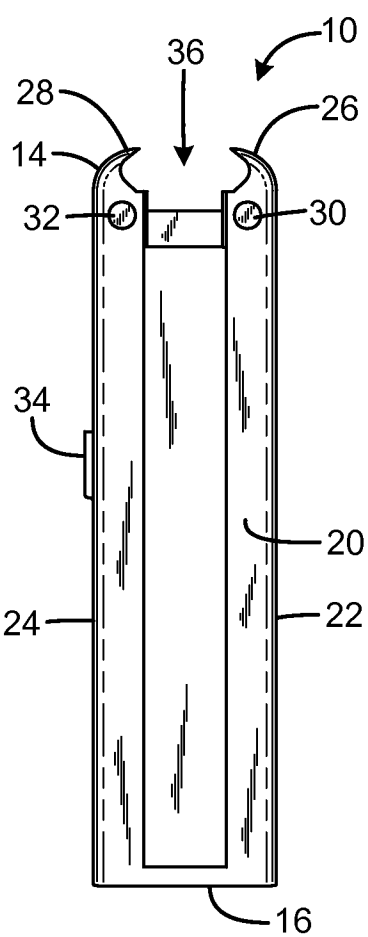
FIG. 1B is a rear view of the drop-in fixed magazine of FIG. 1A.

FIGS. 1A & 1B illustrate the improved drop-in fixed magazine 10 of the present invention. More particularly, the drop-in fixed magazine 10 has a generally tubular body 12. The body has a front 18, rear 20, right side 22, left side 24, top 14, and bottom 16. A recess 34 for the bolt catch 116 (shown in FIGS. 4A-C) is visible in the left side of the body. The top of the body tapers to define an opening 36 bounded by right and left feed lips 26, 28. The bottom of the body is open to receive a follower, coil spring, and a spring plate. A removable bottom plate closes the bottom end of the body and secures the follower, spring, and spring plate within the body. The follower, spring, spring plate, and bottom plate are omitted for clarity.

Figure 2A:
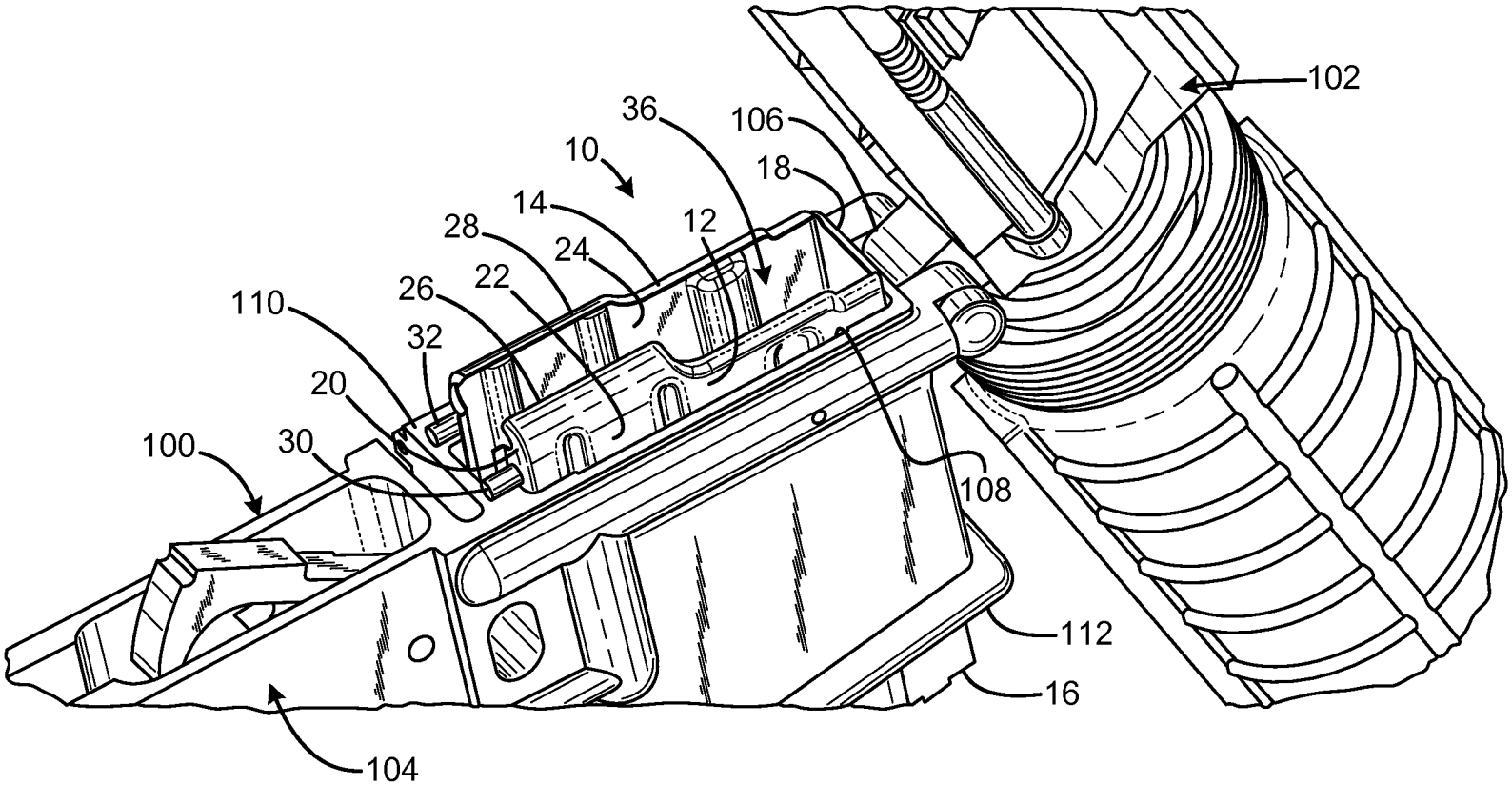
FIG. 2A is a rear isometric partial view of the drop-in fixed magazine of FIG. 1A installed in the magazine well of a rifle with the bolt catch removed.
Figure 2B:
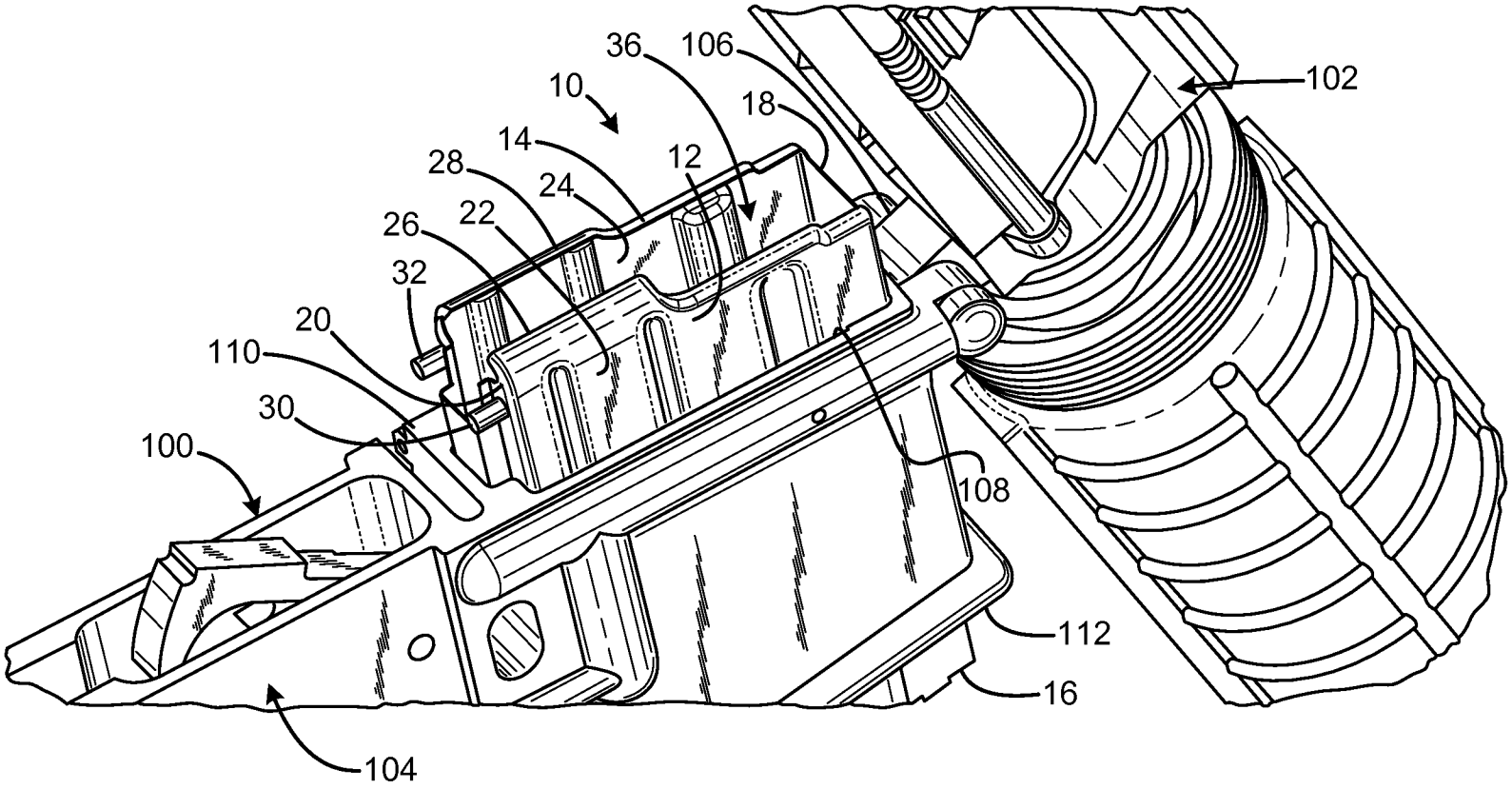
FIG. 2B is a rear isometric partial view of the drop-in fixed magazine of FIG. 1A in the process of being removed from the magazine well of a rifle with the bolt catch removed.

FIGS. 2A & B illustrate the improved drop-in fixed magazine 10 of the present invention. More particularly, the drop-in fixed magazine 10 is shown both installed and in the process of being removed from a firearm 100. A magazine release button 114 (shown in FIG. 4A) connects to a latch (not shown) to removably secure the drop-in fixed magazine within the magazine well 108 of the firearm. The top 14 rear 20 of the magazine body 12 forms two rearward protruding nipples 30, 32 located on the back of the feed lips 26, 28. The nipples prevent the magazine from being removed through the bottom 16 of the magazine well like a conventional detachable box magazine, even when the magazine release button (not shown) is actuated to release the latch. The nipples prohibit the magazine from dropping because the nipples limit downward movement of the magazine via contact with the top 110 of the firearm's lower receiver. To remove the magazine, the operator must first remove the upper receiver 102/disassemble the action by pivoting the upper receiver about a hinge 106, thereby disabling the firearm. The operator subsequently removes the standard bolt catch (not shown), presses the magazine release button to disengage the latch from the horizontal ledge, and pulls the magazine up through the magazine well as shown in FIG. 2B. To install the magazine, the procedure is reversed.

In the current embodiment, the nipples 30, 32 can be made from sheet metal folds made using the single stainless steel sheet metal piece forming the main magazine body 12, such as simple tabs folded out of the rear plane to be parallel with the magazine's medial plane. Alternatively, the nipples can also be made from plastic molds, welded index pins, or by any other method that will resist a user attempting to pull the magazine out through the bottom of the magazine well of the firearm. In the current embodiment, the nipples are 0.125 inches in diameter and extend rearwards by 0.2 inch. The nipples have their centers spaced inwardly from the right and left sides 22, 24 of the magazine body by 0.138 inches in the current embodiment. The nipples have their centers spaced downwardly from the top 14 of the feed lips 26, 28 by a distance of 0.312 inch in the current embodiment. In the current embodiment, the magazine 10 has a capacity of 10 rounds, but the magazine can be adapted to hold any desired quantity of rounds. In the current embodiment, the firearm is a semi-automatic rifle.

Figure 3:
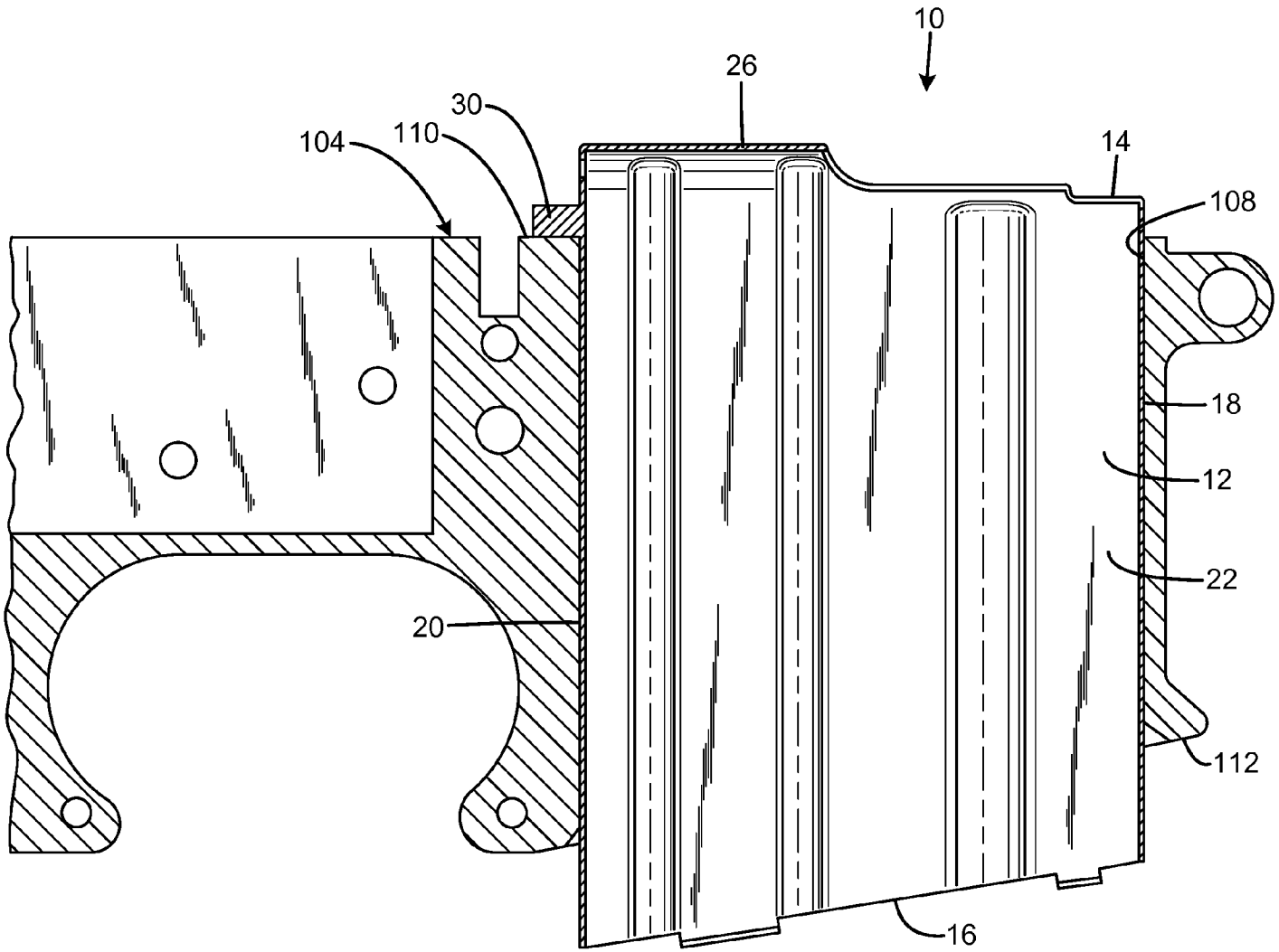
FIG. 3 is a right side partial view of the drop-in fixed magazine of FIG. 1A installed in the magazine well of a rifle with the bolt catch removed.

FIG. 3 illustrates the improved drop-in fixed magazine 10 of the present invention. More particularly, the drop-in fixed magazine 10 is shown installed in a firearm 100 because the firearm has a standard magazine well 108 with a well-defined profile, the magazine can be reliably manufactured to fit closely within that profile without requiring any modifications to the host firearm, while simultaneously preventing the magazine from being installed or removed from the bottom of the magazine well. In order to make the firearm exempt from registration requirements and other legal restrictions applicable to semi-automatic firearms with detachable box magazines, the user merely needs to remove the conventional detachable box magazine, remove the upper receiver 102, insert a loaded drop-in fixed magazine into the magazine well from the top 110, and install the upper receiver.

The drop-in fixed magazine 10 provides additional advantages as well. First, the magazine can be detached from the firearm 100 for loading. Second, an empty drop-in fixed magazine can be removed from the firearm and a previously loaded drop-in fixed magazine can be installed to speed reloading of the firearm.

Figure 4A:
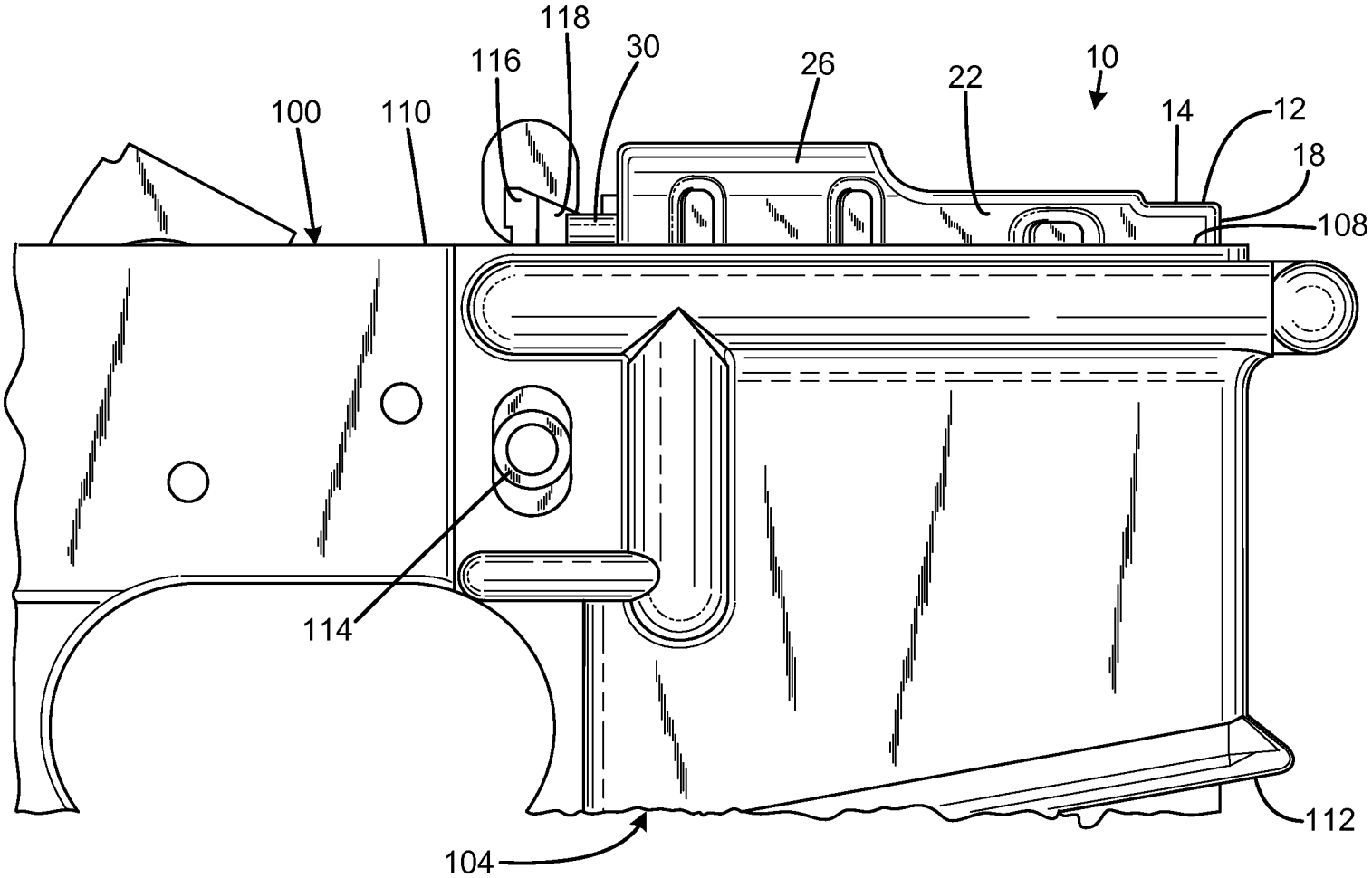
FIG. 4A is a right side partial view of the drop-in fixed magazine of FIG. 1A installed in the magazine well of a rifle with a modified bolt catch installed.
Figure 4B:
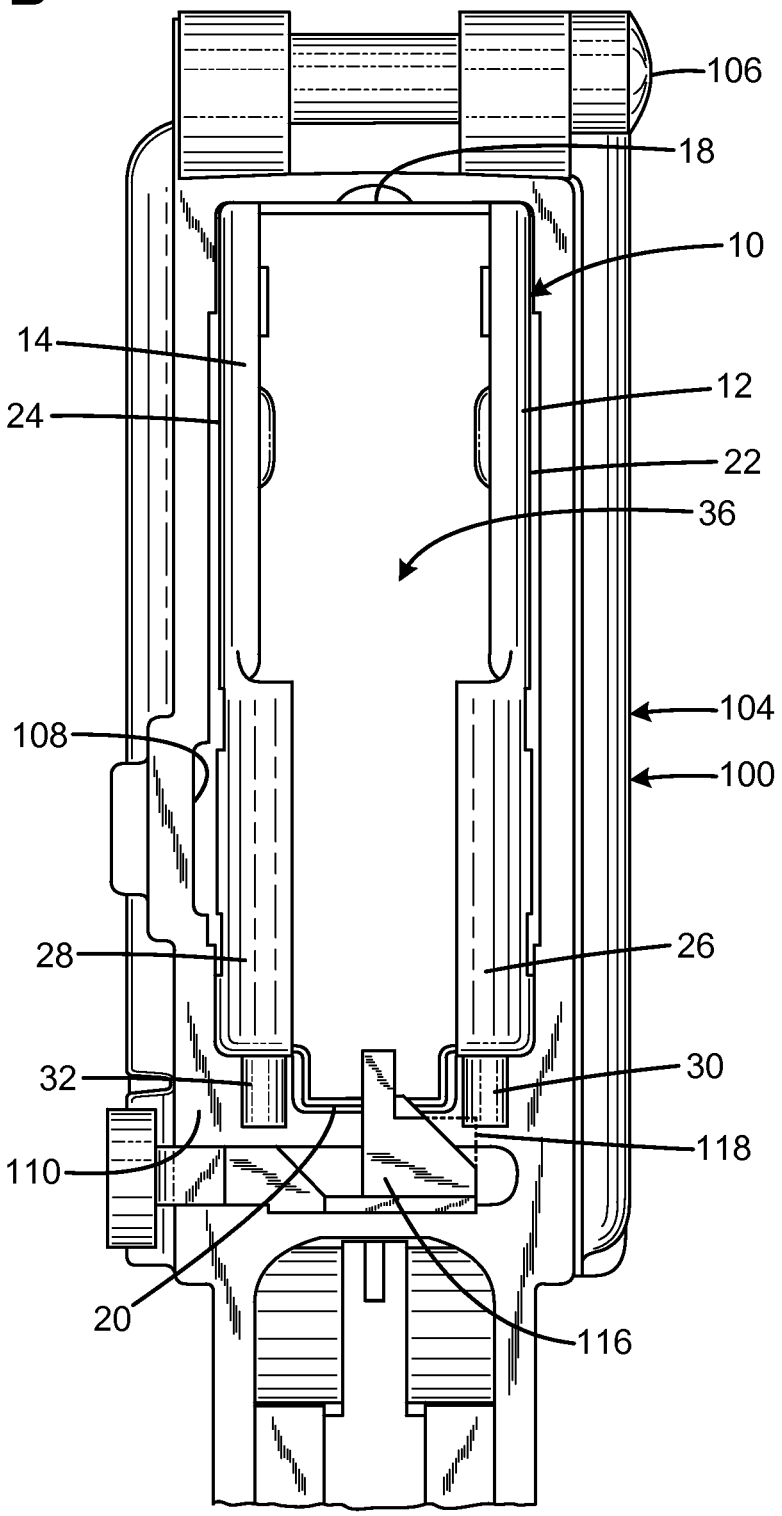
FIG. 4B is a top view of the drop-in fixed magazine of FIG. 1A installed in the magazine well of a rifle with a modified bolt catch installed.
Figure 4C:
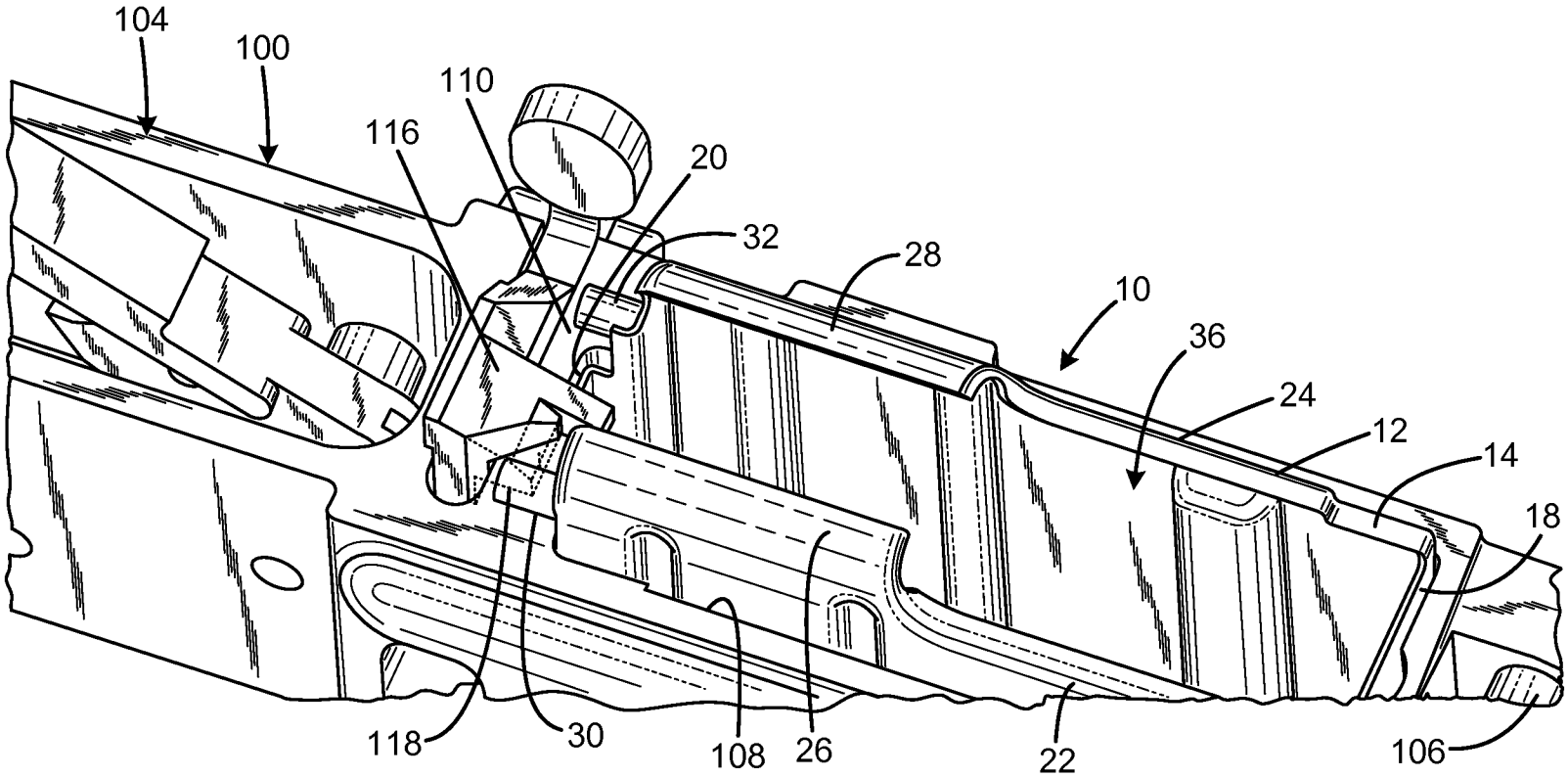
FIG. 4C is a front isometric partial view of the drop-in fixed magazine of FIG. 1A installed in the magazine well of a rifle with a modified bolt catch installed.

FIGS. 4A-C illustrate the improved drop-in fixed magazine 10 of the present invention. More particularly, the drop-in fixed magazine 10 is shown installed in a firearm 100 with a modified bolt catch 116. Although the drop-in fixed magazine can be readily used with an unmodified bolt catch in a firearm 100 as previously described, a minor modification to the bolt catch of the firearm can be made to facilitate easier extraction of the magazine from the magazine well of the firearm. The protrusion on the bolt catch of the firearm, which catches the follower and holds the bolt open after the last round is discharged, can be trimmed to allow free passage of the magazine through the top 110 of the magazine well 108 while the bolt catch remains installed. The trimmed portion 118 is depicted in dashed lines. Without such a modification, the bolt catch must be removed and reinstalled to permit the magazine to be inserted into the magazine well from the top. An unmodified bolt catch prevents removal of the magazine without the use of tools to first remove the bolt catch because the bolt catch overhangs the right nipple 30 of the magazine. While trimming the protrusion on the bolt catch eliminates the last-round bolt-hold-open feature of the firearm, the firearm is otherwise completely operable, and the modification can be reversed by simply installing a replacement, unmodified bolt catch. Furthermore, a conventional detachable magazine can still be used with the rifle even if the modified bolt catch is not replaced with an unmodified bolt catch because the modified bolt catch still works and can be manually articulated.

In the context of the specification, the terms "rear" and "rearward," and "front" and "forward" have the following definitions: "rear" or "rearward" means in the direction away from the muzzle of the firearm while "front" or "forward" means it is in the direction towards the muzzle of the firearm.

While a current embodiment of a drop-in fixed magazine has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A rifle comprising:

a lower receiver defining a magazine well having a selected cross sectional profile;

the magazine well having an upper end and a lower end;

an upper receiver removably pivotally connected to the lower receiver to pivot between a first closed position in which at least a portion of the upper receiver overlays the upper end of the magazine well and a second open position in which the upper end of the magazine well is exposed;

a magazine having a body with a cross sectional profile sized to be slidably closely received in the magazine well;

the magazine having an upper end portion having a lateral protrusion extending beyond the cross sectional profile; and the protrusion being adapted to contact a selected portion of the lower receiver adjacent to the upper end of the magazine well when the magazine is received within the magazine well, such that extraction of the magazine from the lower end of the magazine well is prevented, and such that the upper receiver must be moved away from the lower receiver to enable removal of the magazine from the lower receiver.

2. The rifle of claim 1 further comprising a bolt catch including a protrusion, wherein the bolt catch protrusion terminates such that the bolt catch protrusion does not obstruct vertical movement of the magazine protrusion.

3. The rifle of claim 2 wherein the bolt catch protrusion does not overhang the magazine protrusion.

4. The rifle of claim 1 wherein the selected portion of the lower receiver contacted by the protrusion is the upper end of the lower receiver.

5. The rifle of claim 1 further comprising the upper end of the body including a plurality of lateral protrusions extending beyond the cross sectional profile.

6. The rifle of claim 1 wherein the protrusion extends rearwardly from the body.

7. The rifle of claim 1 wherein the body has a capacity of 10 rounds of ammunition.

8. The rifle of claim 1 wherein the lower end of the body extends below the magazine well.

9. The rifle of claim 1 further comprising the magazine having a floor plate that remains attached to the magazine when the magazine is detached from the firearm.

10. A rifle comprising:

a lower receiver defining a magazine well having a selected cross sectional profile and including a trigger group and hammer;

the magazine well having an upper end and a lower end;

an upper receiver adapted to receive a reciprocating bolt;

the upper receiver detachably connected to the lower receiver by way of at least a takedown pin laterally penetrating the upper receiver and the lower receiver;

at least a portion of the upper receiver overlaying the upper end of the magazine well;

a magazine having a body with a cross sectional profile sized to be slidably closely received in the magazine well;

the magazine having an upper end portion having a lateral protrusion extending beyond the cross sectional profile; and the protrusion being adapted to contact a selected portion of the lower receiver adjacent to the upper end of the magazine well when the magazine is received within the magazine well, such that extraction of the magazine from the lower end of the magazine well is prevented, and such that the upper receiver must be moved away from the lower receiver to enable removal of the magazine from the lower receiver.

11. The rifle of claim 10 further comprising a bolt catch including a protrusion, wherein the bolt catch protrusion terminates such that the bolt catch protrusion does not obstruct vertical movement of the magazine protrusion.

12. The rifle of claim 11 wherein the bolt catch protrusion does not overhang the magazine protrusion.

13. The rifle of claim 10 wherein the selected portion of the lower receiver contacted by the protrusion is the upper end of the lower receiver.

14. The rifle of claim 10 further comprising the upper end of the body including a plurality of lateral protrusions extending beyond the cross sectional profile.

15. The rifle of claim 10 wherein the protrusion extends rearwardly from the body.

16. The rifle of claim 10 wherein the body has a capacity of 10 rounds of ammunition.

17. The rifle of claim 10 wherein the lower end of the body extends below the magazine well.

18. The rifle of claim 10 further comprising the magazine having a floor plate that remains attached to the magazine when the magazine is detached from the firearm.

* * * * *